US007165352B2

(12) United States Patent
Langlotz

(10) Patent No.: US 7,165,352 B2
(45) Date of Patent: Jan. 23, 2007

(54) RIFLE WITH TRIGGER PULL WEIGHT ADJUSTMENT

(76) Inventor: Bennet K. Langlotz, P.O. Box 759, Genoa, NV (US) 89411

( * ) Notice: Subject to any disclaimer, the term of this patent is extended or adjusted under 35 U.S.C. 154(b) by 212 days.

(21) Appl. No.: 10/993,119

(22) Filed: Nov. 18, 2004

(65) Prior Publication Data

US 2006/0101693 A1 May 18, 2006

(51) Int. Cl.
*F41A 19/16* (2006.01)
*F41A 19/12* (2006.01)

(52) U.S. Cl. ..... 42/69.03; 89/132

(58) Field of Classification Search ..... 89/132, 89/27.11; 42/69.03
See application file for complete search history.

(56) References Cited

U.S. PATENT DOCUMENTS 6,131,324 A * 10/2000 Jewell ..... 42/69.03

* cited by examiner

*Primary Examiner*—Stephen M. Johnson
(74) *Attorney, Agent, or Firm*—Langlotz Patent Works; Bennet K. Langlotz

(57) ABSTRACT

A trigger pull weight adjustment element for a firearm having a frame and a trigger spring. The adjustment element has a body with a connection element adapted to connect the body to the frame. The body has a number of spring engaging features each adapted to engage a portion of the spring. The spring engaging features are positioned at different locations such that a different spring force is provided based on which spring engaging feature is engaged. The spring engaging features may be angled with respect to a major axis of the firearm, and there may be only a single such feature, which is angled.

20 Claims, 3 Drawing Sheets

RIFLE WITH TRIGGER PULL WEIGHT ADJUSTMENT

FIELD OF THE INVENTION

This invention relates to firearms, and more particularly to mechanisms for adjusting the trigger pull weight of firearms.

BACKGROUND OF THE INVENTION

Firearms such as rifles generally have differing trigger pull weights depending on the application. The trigger pull weight is the amount of force required to cause a cocked firearm to discharge. Rifles for military issue generally have heavy pull weights to reduce the risk of unintentional discharge by inexperienced troops, or during rough handling during training or combat. Light trigger pull weights are generally preferred when long range accuracy is required, such as by military or police snipers, and by civilians engaged in target or sport shooting.

It is often desirable to make firearms more versatile, so that they are suited to more than one type of use. For instance, a government agency may wish to have only one or a limited number of standard rifles available, to facilitate simplified inventory, training and maintenance. Similarly, a civilian gun owner may prefer to have a single rifle that performs well for different applications instead of having to purchase a separate rifle for each application. In addition, collectors who prefer a particular type of rifle may wish to use it for different types of shooting or hunting activities.

A military rifle such as the Steyr AUG has a relatively heavy trigger pull weight of about 9 pounds. This is heavier than is generally preferred by civilian sport shooters and by those requiring precision long range shooting. Moreover, the AUG trigger requires the trigger to be pulled over this a relatively long distance, so that the total energy needed to pull the trigger is greater than if a 9-pound trigger with a short pull distance were employed. In addition, the bullpup design of the AUG positions the trigger well forward of the mechanism that releases the hammer, requiring long linkages that are prone to friction, further degrading trigger pull.

In the AUG rifle, a trigger spring provides the resistive force that determines the weight of pull. As in any firearms, a spring of different weight or strength may be substituted to achieve a desired weight or pull. However, this requires a user to determine in advance what the desired weight might be, or to try several samples or springs until a desired weight is achieved. Moreover, unless several different springs are owned, the user is limited to only as many weight options as springs he owns. This presents challenges for a soldier in the field seeking to modify the trigger weight, when parts supplies are unavailable. Alternative weight springs must be stored, and may be lost. In addition, a supplier must manufacture and stock a range of different springs to provide a range of different weights, increasing inventory and manufacturing cost.

SUMMARY OF THE INVENTION

The present invention overcomes the limitations of the prior art by providing a trigger pull weight adjustment element for a firearm having a frame and a trigger spring. The adjustment element has a body with a connection element adapted to connect the body to the frame. The body has a number of spring engaging features each adapted to engage a portion of the spring. The spring engaging features are positioned at different locations such that a different spring force is provided based on which spring engaging feature is engaged. The spring engaging features may be angled with respect to a major axis of the firearm, and there may be only a single such feature, which is angled.

DETAILED DESCRIPTION OF A PREFERRED EMBODIMENT

Figure 1:
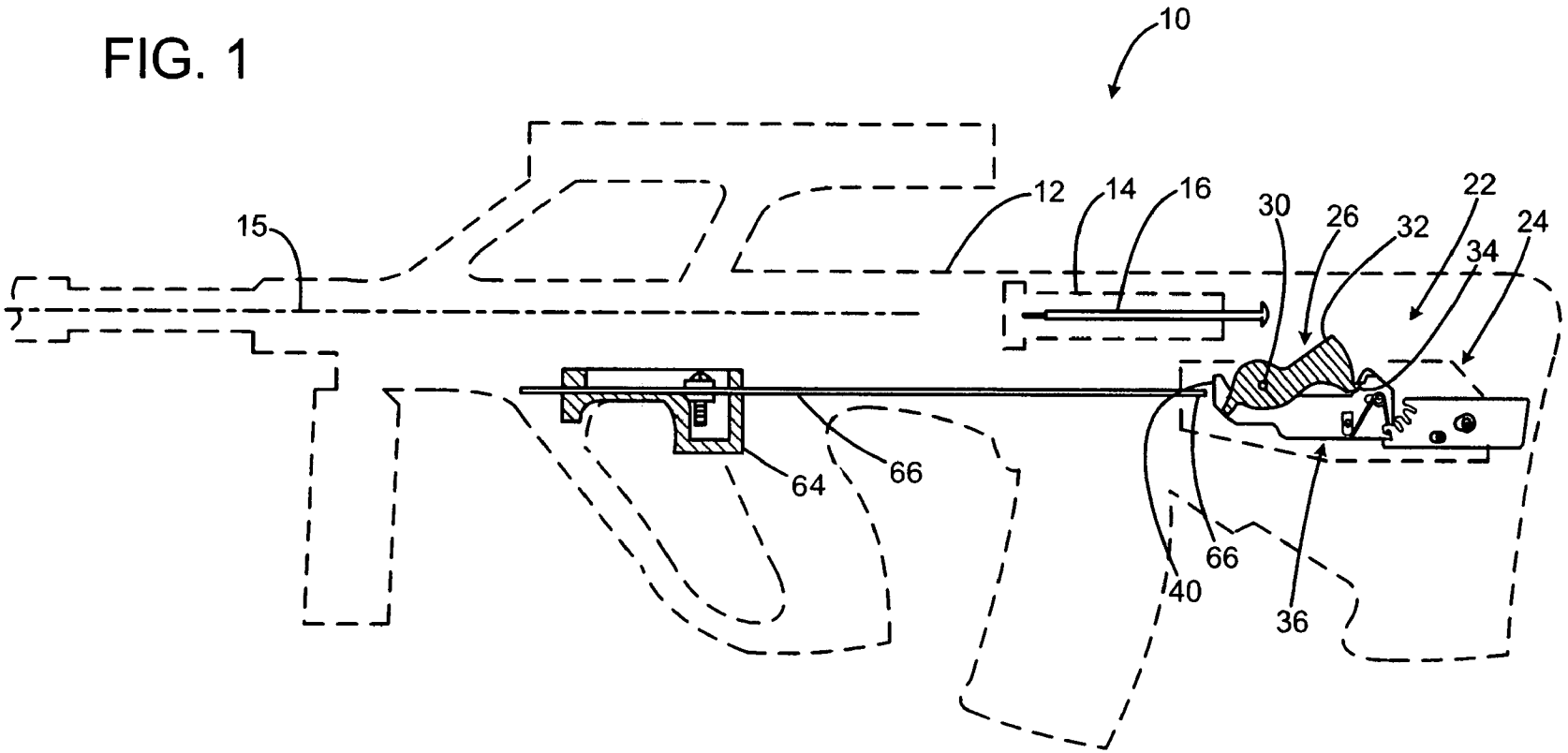
FIG. 1 is a sectional side view of a rifle with a trigger spring element according to a preferred embodiment of the invention.
Figure 2:
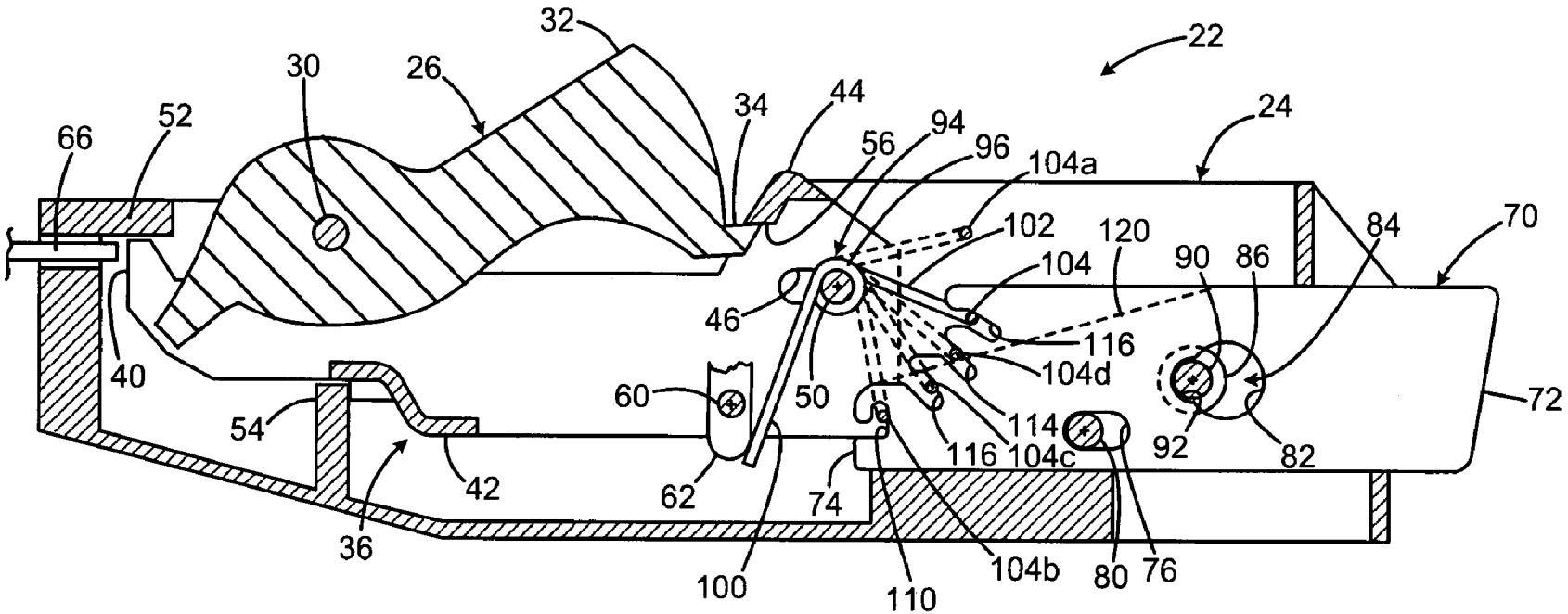
FIG. 2 is an enlarged sectional view of the firing mechanism of the embodiment of FIG. 1.

FIG. 1 shows an auto-loading rifle 10 having a frame 12 that includes a receiver, barrel, stock, and reciprocating bolt 14 in the preferred embodiment, the rifle is a Steyr AUG, produced by Steyr Mannlicher GmbH & Co of Kleinraming, Austria. The firearm and barrel bore define a primary axis 15. The bolt receives a firing pin 16 having a rear end 20 protruding rearward. (For simplicity, directions and orientation nomenclature is given from the perspective of a user of the rifle.) As shown in FIG. 2, a modular hammer group or firing mechanism 22 is removably secured to the frame.

The hammer group includes a trigger mechanism body or housing 24 that is normally fixed with reference to the frame, and which essentially becomes part of the frame when installed. A hammer 26 is pivotally attached to the housing by a horizontally oriented hammer pivot pin 30, perpendicular to the main axis of the rifle formed by the barrel. The pivot pin 30 has ends that are closely received in apertures in the housing 24, so that it is essentially fixed with reference to the frame. The free end of the hammer has a striking surface 32 that faces forward or upward depending on the hammer's position. The rear or lower portion of the hammer's free end includes a hook 34 having an upwardly or forwardly facing ledge that faces counterclockwise in the view shown, in a plane approximately radial to the hammer pin axis. The hammer is heavily spring-biased in the counterclockwise direction (as viewed from the left, and in the illustration) so that when released from the cocked position shown to a fired or released condition, the hammer's striking surface 34 strikes the rear end of the firing pin, discharging the rifle.

A trigger mechanism slide or sear body 36 is a sled-like body that resides in the housing, and which reciprocates along the primary axis of the rifle. The sear body has forward end surfaces 40 in a vertical plane. The sear body extends horizontally rearward, with side walls defining a space for the hammer to reside between. A lower bridge 42 extends between the lower edges of the side walls at an intermediate portion along the length of the walls, and an upper bridge 44 extends between the upper edges of the walls rearward of the lower bridge. Together, the bridges provide structural integrity for the sear body. The sidewalls each define oblong apertures 46 registered with each other at a position approximately in line with and at a level below the upper bridge. The apertures 46 are elongated along an axis parallel to the firearm axis, and have semicircular ends. A horizontally-oriented sear body guide pin 50 occupies the apertures 46, and extends laterally beyond the sear body on each side to be closely received in the housing 24. Thus, pin 50 is essentially fixed with reference to the frame. Lateral motion of the sear body is limited by the close fitting channel of the housing 24 in which it slides, and vertical motion of the forward end of the sear body is constrained by crossbar elements 52, 54 of the housing. Vertical movement of the rear end of the sear body is prevented by pin 50, which closely fits within the elongated aperture 46. The length of the aperture permits the sear body to reciprocate between the forward position shown, and a rearward position.

The upper bridge 44 of the sear body includes a downward facing sear surface 56 against which the ledge of the hammer hook rests when the hammer is cocked, and when the sear body is in the forward position. When the sear is pushed to the rear position, the hammer is released and the rifle discharges. The sear body closely receives a disconnector pin 60 upon which a disconnector element 62 pivots. The disconnector operates conventionally to prevent unwanted multiple discharges that would otherwise occur if the trigger were not immediately released after a shot. As shown in FIG. 1, a trigger element 64 resides in the frame with a range of motion parallel to the rifle axis between a released position shown and an actuated position to the rear. A connecting rod element is secured to the trigger, and extends to rear ends 66 that press on the forward surfaces 40 of the sear body. Thus, pressing the trigger shifts the rod and sear body rearward, allowing the hammer to pivot.

Returning to FIG. 2, the firing mechanism 22 includes a pin-retaining lock element or spring support element 70. The support element 70 is a generally flat, planar, rectangular elongated body that is aligned with the rifle axis, in a vertical plane. The housing 24 defines a channel with supports to constrain the element 70 to reciprocating movement in line with the rifle axis. A rear end 72 of the element 70 protrudes rearward from the housing 24, and a forward end 74 extends toward the sear body, and defines several notches or channels as will be discussed below. An intermediate portion of the element 70 defines a horizontally elongated aperture 76 that receives a housing-mounted pin 80, limiting the amount by which the element may reciprocate in the rifle axis direction. The element further defines a retaining pin aperture 82 that receives a retaining pin 84. The retaining pin has a shoulder 86 and a smaller diameter shank 90, and the aperture 82 is in the form of a circle sized to receive the shoulder, plus a forwardly-extending arc cutout 92 that is sized to receive the shank and not the shoulder. Thus, when the pin retaining element 70 is in a rear position as shown, the retaining pin may not be removed. Pressing forward on the rear end of the element shifts it to a forward position for dismantling the rifle, by removing the shouldered pin, and then removing the firing mechanism from the frame. In normal operation other than dismantling, the element 70 is stationary in the rear position shown, and the retaining pin 84 (and housing 24) is fixed to the rifle frame.

A sear spring 94 biases the sear body in a forward direction, employs the forward end of the spring support element 70 as a fixed support, and provides a biasing force that establishes the weight of the trigger pull. The spring is a torsion spring with a closely-wound coil 96 encompassing the sear body guide pin 50, and having a forward leg 100 that presses forward on the disconnector (which although slightly movable during certain phases of firing, functions as a fixed portion of the sear body for purposes of this disclosure—this spring also providing a biasing force for the disconnector.) The spring has a rear leg 102 having an orthogonal J-shaped end. A leg 104 is bent laterally in a direction perpendicular to the plane of the element 70. A free leg (not shown) is parallel to the main leg 102, and points back toward the coil 96 from the opposite end of the leg 104.

The element 70 has a first notch 110, second notch, 112, third notch, 114, and fourth notch 116. Each notch extends the thickness of the part, which is simply a plate with apertures and the illustrated periphery. Thus, it may be formed by two-dimensional means such as laser cutting or machining of sheet goods, as an alternative to conventional injection molding or machining. In the preferred embodiment as in the prior art original element found in existing Steyr AUG rifles, the element is 6.0 mm thick, 19 mm tall, and 67 mm long. It is formed of a rigid thermoplastic. The prior art stock element is essentially as illustrated, except with only the single notch 110, and no notches 112, 114, and 116. The prior art element has a sloped forward portion 120 of the upper surface.

Unloaded, the spring 94 has a free angle that positions the leg at an elevated position 104*a*. The maximum (and prior art stock) trigger force of 9 pounds is obtained with an approximately 90 degree deflection to a leg position 104*b* in the first notch. When the leg is in the second notch 112 at position 104*c*, the spring is at a deflection angle of 70 degrees, for a spring force (and trigger pull) of approximately 7 pounds. When the leg is in the third notch 114 at position 104*d*, the spring is at a deflection angle of 50 degrees, for a spring force (and trigger pull) of approximately 5 pounds. When the leg is in the fourth notch 116 at position 104, the spring is at a deflection angle of 35 degrees, for a spring force (and trigger pull) of approximately 3.5 pounds. Because of the short engagement overlap of the sear surface and hammer hook, the amount by which the spring flexes before firing only minimally increases the perceived force during the distance the trigger is pulled.

The notches are positioned in an arc defined by the sweep of the spring leg end 104. Each notch is oriented approximately radially to the tangent point on the spring coil. Each notch has a bearing surface on which the leg 104 presses upwardly and/or rearwardly. The bearing surfaces of the first, second, third, and fourth notches 110, 112, 114, and 116 are oriented with respect to the horizontal rifle axis at 90°, 60°, 45°, and 30°, respectively. The thickness of the protrusions between the notches at the point of contact by the leg 104 is at about 2.5 mm to provide structural integrity.

Figure 3:
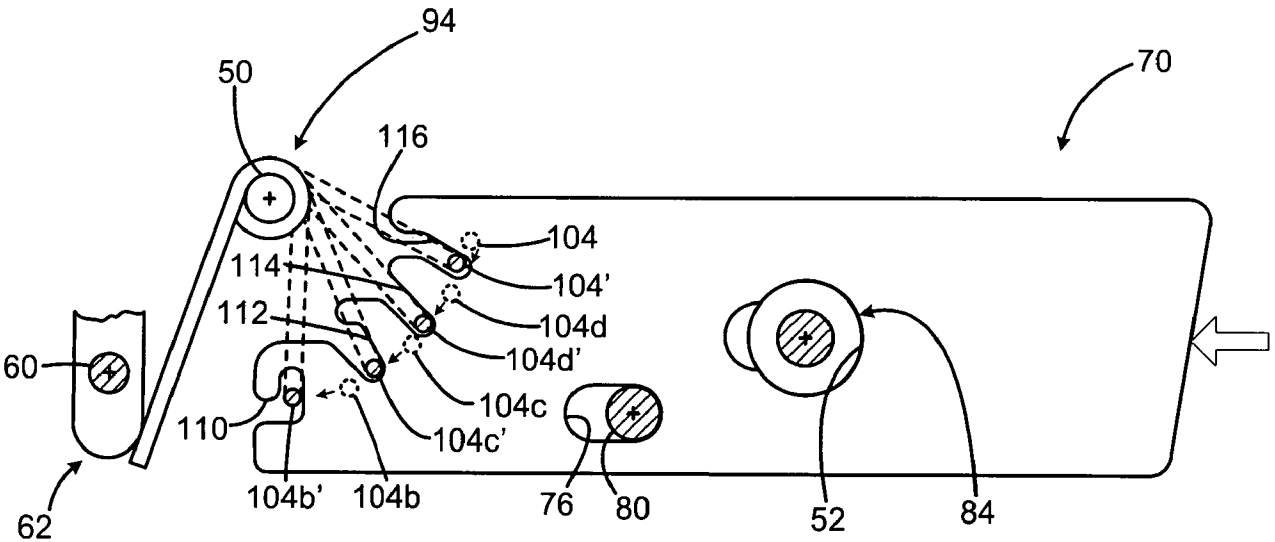
FIG. 3 is an enlarged sectional view of the firing mechanism of the embodiment of FIG. 1 in a depressed condition.

Each of the notches extends to a depth greater than would appear to be needed to accommodate the spring leg 104 when the spring support element 70 is in the rear position for normal operation. In FIG. 3, the element 70 has been pressed forward for dismantling the rifle. The pin 80 is limiting the forward motion at the aperture 76, and the retaining pin 84 is aligned with the major portion of the hole 82 for extraction (thereby permitting the firing mechanism to be removed from the rifle frame).

With the element 70 shifted forward, the spring leg must shift in position. When in slot 110, leg position 104*b* has shifted to position 104*b*', in a generally forward direction, so that the spring force of 9 pounds resists this motion by that amount of resistive force. When in slot 112, leg position 104*c* has shifted to position 104*c*', in a downward angle of about 30 degrees from the horizontal, in a direction perpendicular to the bearing surface direction, so that resistive force is a lesser amount based on the geometry and the mechanical advantage provided by the angle. When in slot 114, leg position 104*d* has shifted to position 104*d*', in a downward angle of about 45 degrees, in a direction perpendicular to the bearing surface direction, with similar effects to provide limited but adequate resistive force to prevent unintended depression of the element 70. When in slot 116, leg position 104 has shifted to position 104', in a generally downward direction perpendicular to the bearing surface, with force that may require assistance to restore the desired position.

To provide increased force to resist unintended actuation, and to ensure positive return of the element 70 to the rear position to secure the retaining pin when the rifle is assembled, the angle of the notch (especially the upper notch) may be increased with respect to the horizontal. While the rifle would operate if this or other notches were horizontal, there would be nothing other than friction to prevent unwanted actuation of the element 70, and the user would be required to pull on the rear of the element to lock the retaining pin in place. While a 30° angle is adequate to avoid unintended actuation, and is employed in the illustrated embodiment to provide adequate material thickness between notches, an alternative embodiment may use reduced material dimensions or, as in the embodiment discussed below, may have few or differently located notches to allow wider spacing between notches. A further alternative embodiment may have only one notch in a position other than the original prior art notch 110, and with an angled surface upon which the spring leg 104 bears.

For the prior art notch 110, the vertical bearing surface is adequate because the spring leg 104*b* is near the horizontal tangent to the leg's path, and thus there is very little friction resisting the actuation of the element 70. However, for positions that depart from this "six-o'clock" position, a vertical bearing surface presents increasing frictional resistance and wear as the angle deviates from the vertical. For angles approaching the horizontal, as with notch 116, a vertical surface would simply prevent disassembly, as friction would be adequate to bind the leg to the bearing surface in a stable manner. Thus, for positions departing significantly from the prior art slot 110 positioned vertically below the spring coil, bearing surface angles must deviate adequately from the vertical to allow depression of the element 70 without excessive friction, and must deviate adequately from the horizontal to provide adequate resistive and restorative force. The range of 30 to 60 degrees deviation from either orthogonal direction is believed suitable for all such positions.

In an alternative embodiment, the element 70 may be provided with only a single notch, but in a different position than in the prior art notch 110. This requires a notch bearing surface at an angle as noted above. Other embodiments may be provided with no notch, so that a user may cut his own notch at a desired position to provide a desired trigger weight. In such instances, the element 70 may be inscribed with a pattern and indicia to inform the user of the needed notch angle and depth for each position, and to indicate the resulting trigger weight.

Figure 4:
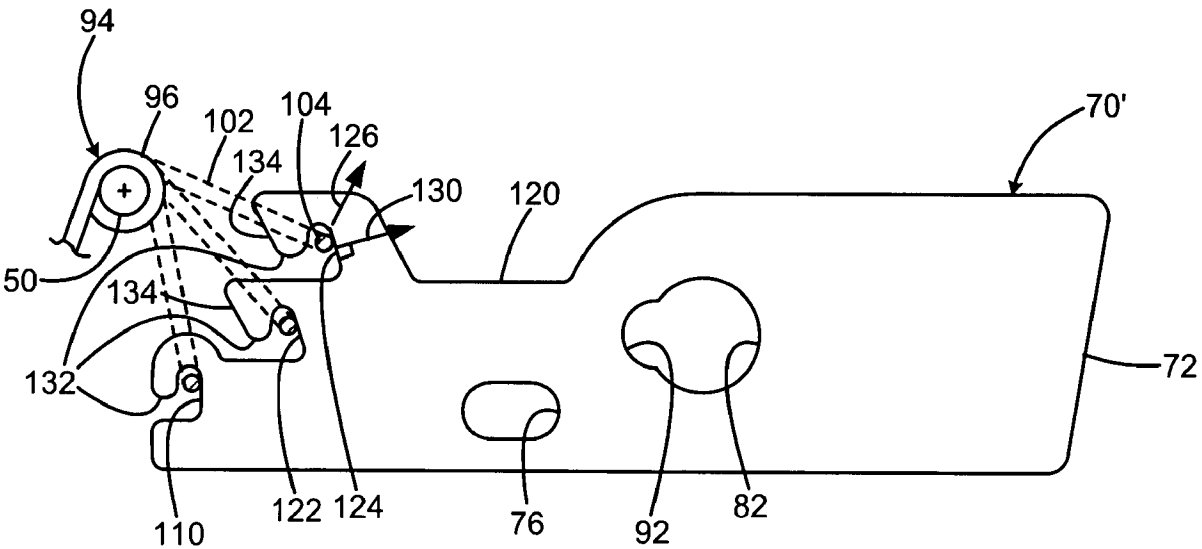
FIG. 4 is a side view of a spring support element according to an alternative embodiment of the invention.

FIG. 4 shows an alternative spring support element 70' having several differences from the embodiment above. The top edge has a relief cut 120 that provides clearance for installation, particularly enabling the element to be elevated when installing the spring leg 104 in a selected notch or for installing the element. The element has only three notches instead of four. The first notch 110 is the same as in the embodiment above. The second notch 122 and third notch 124 each have bearing surfaces upon which the spring leg 104 bears. These bearing surfaces are oriented more nearly vertically that in the first embodiment, at approximately 70° from the horizontal rifle barrel axis. This does not affect the spring and trigger function during firing, as the spring leg is stationary during firing. However, when shifting the element 70' forward for dismantling, the element 70' has less mechanical advantage over the spring, so that inadvertent dismantling is prevented. Moreover, the spring has a corresponding substantial mechanical advantage to bias the element 70' to the rearward locked position shown in the figures. The trigger pull weight is about 9 pounds in notch 110, 6 pounds in notch 122, and 3.5 pounds in notch 124.

To provide adequate advantage to restore this position in spite of frictional forces, the bearing surfaces are arranged so that the direction of force 126 of the spring leg 104 provides adequate, but not excessive resistance and restoration force. For the more critical surface 124, the force direction 126 is about 70° elevated above a rearward direction, and the reverse normal angle 130 of the surface 124 must be adequately but not excessively deviant from the force direction 126. A direction 130 that approaches the direction 126 will generate excessive friction as the force binds the element 70' in position, instead of shifting it rearward. A direction 130 that approaches the vertical will allow restoration, but will require excessive force to shaft the element for dismantling (and which may simply flex the spring leg.) Thus, direction 130 is at an intermediate angle of 20 degrees elevation from the rearward direction, which deviates from direction 126 by about 50 degrees. This allows the nearly upward force of the spring leg to be converted to a rearward for shifting the element to the locked position, and allows mechanical advantage for the reverse motion against the spring force. This value may range between 40° and 60°.

Each of the notches has a lobe 132 that is forward of the position at which the leg 104 rests. In particular, the lobe interrupts the line between the leg position 104 and the spring coil 96. This allows the J-shaped spring's main leg 102 and free leg to be positioned on opposite sides of the lobe, preventing the spring from shifting laterally out of position along the pin 50.

In addition, each of the upper two lobes has an angled front surface 134 that faces forward and downward to help guide the spring leg 104 downward beneath the lobe during installation.

This disclosure is made in terms or preferred and alternative embodiments, and is not intended to be so limited.

The invention claimed is:

1. A trigger pull weight adjustment element for a firearm having a frame and a sear spring, the element comprising:

a body connected to the frame;

the body having a plurality of spring engaging features each adapted to engage a portion of the spring;

the spring engaging features being positioned at different locations such that a different spring force is provided based on which spring engaging feature is engaged; and wherein the body has an elongated planar shape and defines an elongated aperture oriented parallel to the length of the body, and adapted to receive a pin connected to the frame, such that the body is constrained to reciprocate along its length by an amount limited by the length of the elongated aperture.

2. The apparatus of claim 1 including a second aperture formed of overlapping circles of different radii, such that a shouldered retaining pin is captured when the body is in a first position, and removable when the body is in a second position in which the shoulder aligns with the larger of the overlapping circles.

3. The apparatus of claim 1 wherein the spring engaging features are channels defined in the body.

4. The apparatus of claim 3 wherein at least selected surface portions of at least some of the channels are angled with respect to an axis defined by the length of the body.

5. The apparatus of claim 3 wherein the body is a planar body oriented in a vertical plane, and wherein the channels are defined by surfaces extending perpendicularly to the vertical plane through the thickness of the element, and wherein the spring is a torsion spring having a horizontal leg portion received by any one of the channels.

6. The apparatus of claim 1 including an attached sear, hammer, trigger, connecting elements, receiver, bolt and barrel.

7. The apparatus of claim 1 wherein the spring is a torsion spring including a helical coil encompassing a spring pin connected to the frame and a leg having a contact portion contacting a selected one of the spring engaging features.

8. The apparatus of claim 7 wherein the selected spring engaging feature is positioned a selected limited distance from the coil to allow the leg to rise to an angle significantly deviated from the horizontal.

9. The apparatus of claim 8 wherein the spring leg is allowed to deflect at least 30 degrees from the vertical.

10. The apparatus of claim 7 wherein the contact portion of the spring has a sweep of motion that describes an arc, and wherein the selected spring engaging feature is positioned above the level of the lower tangent to the arc.

11. The firearm of claim 1 wherein at least one of the spring engaging features includes a spring contact surface defining a normal direction angled with respect to a barrel axis of the firearm.

12. A trigger pull weight adjustment element for a firearm having a frame and a sear spring, the element comprising:

a body connected to the frame;

the body having a plurality of spring engaging features each adapted to engage a portion of the spring;

the spring engaging features being positioned at different locations such that a different spring force is provided based on which spring engaging feature is engaged; and the body including a second aperture formed of overlapping circles of different radii, such that a retaining pin having a shoulder is captured when the body is in a first position, and removable when the body is in a second position in which the shoulder aligns with the larger of the overlapping circles.

13. The apparatus of claim 12 wherein the spring engaging features are channels defined in the body.

14. The apparatus of claim 13 wherein at least selected surface portions of at least some of the channels are angled with respect to an axis defined by the length of the body.

15. The apparatus of claim 13 wherein the element is a planar body oriented in a vertical plane, and wherein the channels extend perpendicularly to the vertical plane through the thickness of the element, and wherein the spring is a torsion spring having a horizontal leg portion received by any one of the channels.

16. The apparatus of claim 13 wherein at least selected surface portions of at least some of the channels are angled with respect to an axis defined by the length of the body.

17. The apparatus of claim 12 including at least three different spring engaging features, such that three different trigger pull weights are available.

18. The apparatus of claim 12 including an attached sear, hammer, trigger, connecting elements, receiver, bolt and barrel.

19. A trigger pull weight adjustment element for a firearm having a frame and a sear spring, the element comprising:

a body connected to the frame;

the body having a plurality of spring engaging features each adapted to engage a portion of the spring;

the spring engaging features being positioned at different locations such that a different spring force is provided based on which spring engaging feature is engaged;

wherein the spring engaging features are channels defined in the body;

wherein the element is a planar body oriented in a vertical plane;

wherein the channels extend perpendicularly to the vertical plane through the thickness of the element; and wherein the spring is a torsion spring having a horizontal leg portion received by any one of the channels.

20. The apparatus of claim 19 including at least three different spring engaging features, such that three different trigger pull weights are available.

* * * * *